US011495869B2

(12) United States Patent
Raeesi et al.

(10) Patent No.: US 11,495,869 B2
(45) Date of Patent: Nov. 8, 2022

(54) PLANAR MEMS-BASED PHASE SHIFTER HAVING A MEMS ACTUATOR FOR ADJUSTING A DISTANCE TO PROVIDE A PHASE SHIFT

(71) Applicant: C-COM SATELLITE SYSTEMS INC., Ottawa (CA)

(72) Inventors: Amir Raeesi, Kitchener (CA); Naime Ghafarian, Waterloo (CA); Suren Gigoyan, Waterloo (CA); Safieddin Safavi-Naeini, Waterloo (CA)

(73) Assignee: C-COM SATELLITE SYSTEMS INC., Ottawa (CA)

( * ) Notice: Subject to any disclaimer, the term of this patent is extended or adjusted under 35 U.S.C. 154(b) by 0 days.

(21) Appl. No.: 17/116,593

(22) Filed: Dec. 9, 2020

(65) Prior Publication Data

US 2021/0175590 A1 Jun. 10, 2021

(30) Foreign Application Priority Data

Dec. 9, 2019 (CA) ..... 3064242

(51) Int. Cl.
*H01P 1/18* (2006.01)
*H01P 3/00* (2006.01)

(52) U.S. Cl.
CPC ..... *H01P 1/184* (2013.01); *H01P 3/006* (2013.01)

(58) Field of Classification Search
CPC ..... H01P 1/184; H01P 3/006
USPC ..... 333/161
See application file for complete search history.

(56) References Cited

U.S. PATENT DOCUMENTS 6,987,488 B1 * 1/2006 Chang et al. ..... H01Q 13/085 333/161
2008/0272857 A1 * 11/2008 Singh ..... H01P 1/184 333/161
2015/0372361 A1 * 12/2015 Abdellatif et al. ..... H01P 1/184 333/135

* cited by examiner

*Primary Examiner* — Benny T Lee
(74) *Attorney, Agent, or Firm* — Pearne & Gordon LLP

(57) ABSTRACT

A planar micro-electromechanical system (MEMS)-based phase shifter is described which comprises a dielectric substrate, a grounded coplanar waveguide (GCPW) transmission line for carrying input and output signals, a high-resistivity silicon (HRS) slab coated with metallic gratings over the GCPW line, and a MEMS actuator for adjusting a distance between the HRS slab and the GCPW line to provide a phase shift.

12 Claims, 15 Drawing Sheets

(b)

(a)

PLANAR MEMS-BASED PHASE SHIFTER HAVING A MEMS ACTUATOR FOR ADJUSTING A DISTANCE TO PROVIDE A PHASE SHIFT

CROSS REFERENCE TO RELATED APPLICATIONS

This application claims the benefit of priority based on Canadian Application No. 3,064,242, filed on Dec. 9, 2019, entitled, "PLANAR MEMS-BASED PHASE SHIFTER," the disclosure of which is hereby incorporated by reference herein.

TECHNICAL FIELD

The present invention relates to phase shifters, and particularly to planar micro-electromechanical system (MEMS)-based phase shifters.

BACKGROUND

Phased array systems are rapidly growing for emerging millimeter-wave communication systems such as 5G, automotive radar and mobile satellite communications. A phase shifter is a critical component in millimeter-wave phased array systems as the phase shifter provides the required phase shift for the radio frequency (RF) signal. There is an increasing desire for phase shifters to have low insertion loss, low insertion loss variation, linear phase frequency response, low power consumption, and low cost.

Different techniques and approaches have been adopted for achieving phase tuning. Ferroelectric phase shifters provide fast tuning speed, high power handling capability, and low power consumption. However, the ferroelectric phase shifters suffer from high insertion loss variations. Silicon-based passive phase shifters such as reflective-type phase shifters provide a good planar solution at millimeter-wave frequencies and have been used extensively in modern phased array systems. Nevertheless, the Silicon-based passive phase shifters show high insertion loss and high insertion loss variation. Switched-line phase shifters that employ micro-electromechanical system (MEMS) switches have much less insertion loss and insertion loss variation. However, conventional MEMS phase shifters usually have high profile, high driving voltages and/or high fabrication costs which limit the ability of mass production in commercial phased-array systems.

SUMMARY OF THE INVENTION

There is therefore a desire to provide a tunable phase shifter that addresses at least some of the above problems.

According to various embodiments of the invention, a high-resistivity silicon (HRS) slab coated with metallic gratings is employed as a perturber and is placed over a grounded coplanar waveguide (GCPW) line. A vertical distance between the HRS slab and the GCPW line is variable to achieve phase tuning. The vertical distance can be controlled by moving the HRS slab towards or away from the GCPW line by a low-cost and low-profile magnetic actuation system.

According to one aspect of the invention, a planar micro-electromechanical system (MEMS)-based phase shifter is provided which comprises a dielectric substrate; a GCPW transmission line for carrying input and output signals; a high-resistivity silicon (HRS) slab coated with metallic gratings disposed over the GCPW line; and a MEMS actuator for adjusting a distance between the HRS slab and the GCPW line to provide a phase shift.

BRIEF DESCRIPTION OF THE DRAWINGS

These and other features of the invention will become more apparent from the following description in which reference is made to the appended drawings, where like features are denoted by the same reference labels throughout the drawings and throughout the detailed description of the invention.

FIG. 4(*a*) is a HRS slab coated with metallic gratings as the perturber; FIG. 4(*b*) shows only metallic gratings as the perturber; and FIG. 4(*c*) shows only a slab of HRS as the perturber.

FIG. 9(*b*) shows the magnitude of the electric field for a gap value of 18 um; FIG. 9(*c*) shows the magnitude of the electric field for a gap value of 45 um.

FIG. 10(*b*) shows a top view of the planar 2-layer spiral coil.

FIG. 13(*b*) shows an optical microscope image of a fabricated HRS slab coated with metallic gratings after the $Al_2O_3$ layer deposition.

FIG. 13(*c*) is a schematic cross-sectional view of the grating structure, according to one embodiment of the description.

DETAILED DESCRIPTION OF THE INVENTION

Figure 1:
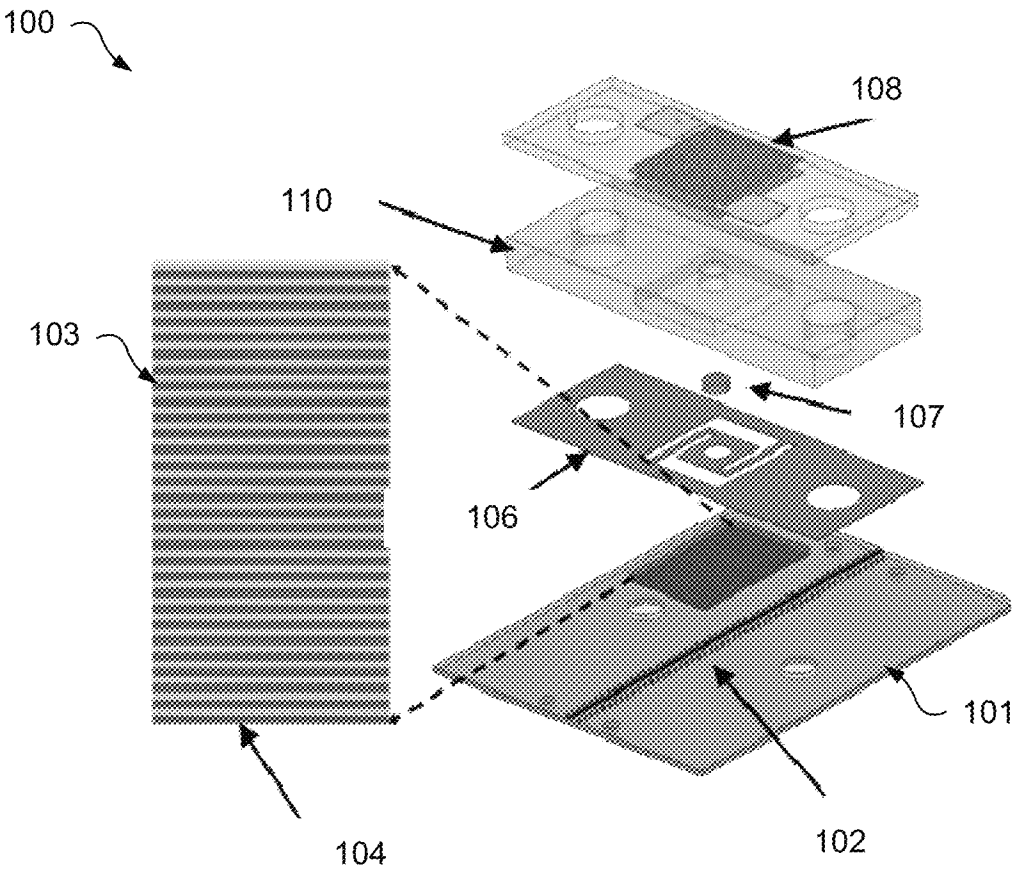
FIG. 1 is an exploded view of the structure of the phase shifter, according to one embodiment of the description.

Although the following detailed description contains, for the purposes of explanation, numerous specific details in order to provide a thorough understanding of the preferred embodiments of the invention. It is apparent, however, that the preferred embodiments may be practiced without these specific details or with an equivalent arrangement. The description should in no way be limited to the illustrative implementations, drawings, and techniques illustrated below, including the exemplary designs and implementations illustrated and described herein.

Traditional passive phase shifters have high loss variation with changing phase. When the passive phase shifters are used in phased array antennas, the antenna beam (radiation pattern) can be highly distorted while steering the beam. As well, passive phase shifters at the millimeter-wave frequency range may have high average insertion loss to account for. Higher insertion loss variation leads to a significant distortion of the radiation pattern while the beam is being steered. Using variable gain amplifiers/attenuators to compensate for the change in the phase shifter insertion loss is one way to solve this problem; however, this approach adds to the design complexity, overall cost, power consumption and/or noise level of the integrated system.

For active phased arrays with a high precision beam pointing, each individual antenna element may be integrated with an individual phase shifter. This imposes a stringent size constraint on the total foot print of the phase shifting element. For example, for Ka-band phased arrays operating at a frequency of 30 GHz, each phase shifter having individual active and passive peripherals may occupy only a small area (e.g., 5 mm×5 mm). Commercial phased array systems also desire low cost integration and fabrication. The size limitation and the lack of a low cost packaging solution for mass-production in some existing solutions make such phase shifters difficult for the use in large commercial phased arrays.

According to one aspect of the description, an approach for phased arrays is exploited that provides a phase shifter exhibiting low average insertion loss as well as low insertion loss variation throughout the tuning range. The use of a low-cost and low-profile magnet actuation system also allows for a simple, low cost and low power consumption system.

According to various embodiments of the description, the phase shifter includes a high-resistivity silicon (HRS) slab coated with metallic gratings and a grounded coplanar waveguide (GCPW) transmission line. The FIRS slab coated with metallic gratings acts as a perturber and is placed over the GCPW transmission line. A vertical distance (hereinafter may be referred to as "gap") between the FIRS slab and the GCPW line is variable to effect phase shift. The gap can be controlled by moving the perturber towards or away from the GCPW line and the movement of the perturber is controlled by a low-cost and low-profile magnet actuation system. In various embodiments of the description, the magnet actuation system is a micro-electromechanical system (MEMS) actuator.

FIG. 1 illustrates the structure of the phase shifter 100, according to one embodiment of the description. The phase shifter 100 includes a dielectric substrate 101, a GCPW transmission line 102 formed on the dielectric substrate 101, and a perturber 104 having metallic gratings 103. A MEMS actuator 106, 107, 108, 110 is provided for adjusting the distance between the perturber 104 and the GCPW transmission line 102.

The MEMS actuator 106, 107, 108, 110 includes a membrane 106, a magnet 107, a planar two-layer spiral coil 108 and a package 110 for enclosing the components of the MEMS actuator and the perturber 104. According to the embodiment, the perturber 104 is attached to one side of the membrane 106 of the MEMS actuator. When the membrane 106 is moved with magnetic force, the perturber 104 moves along with the membrane 106 thereby changing the gap between the perturber 104 and the GCPW line 102.

Figure 2:
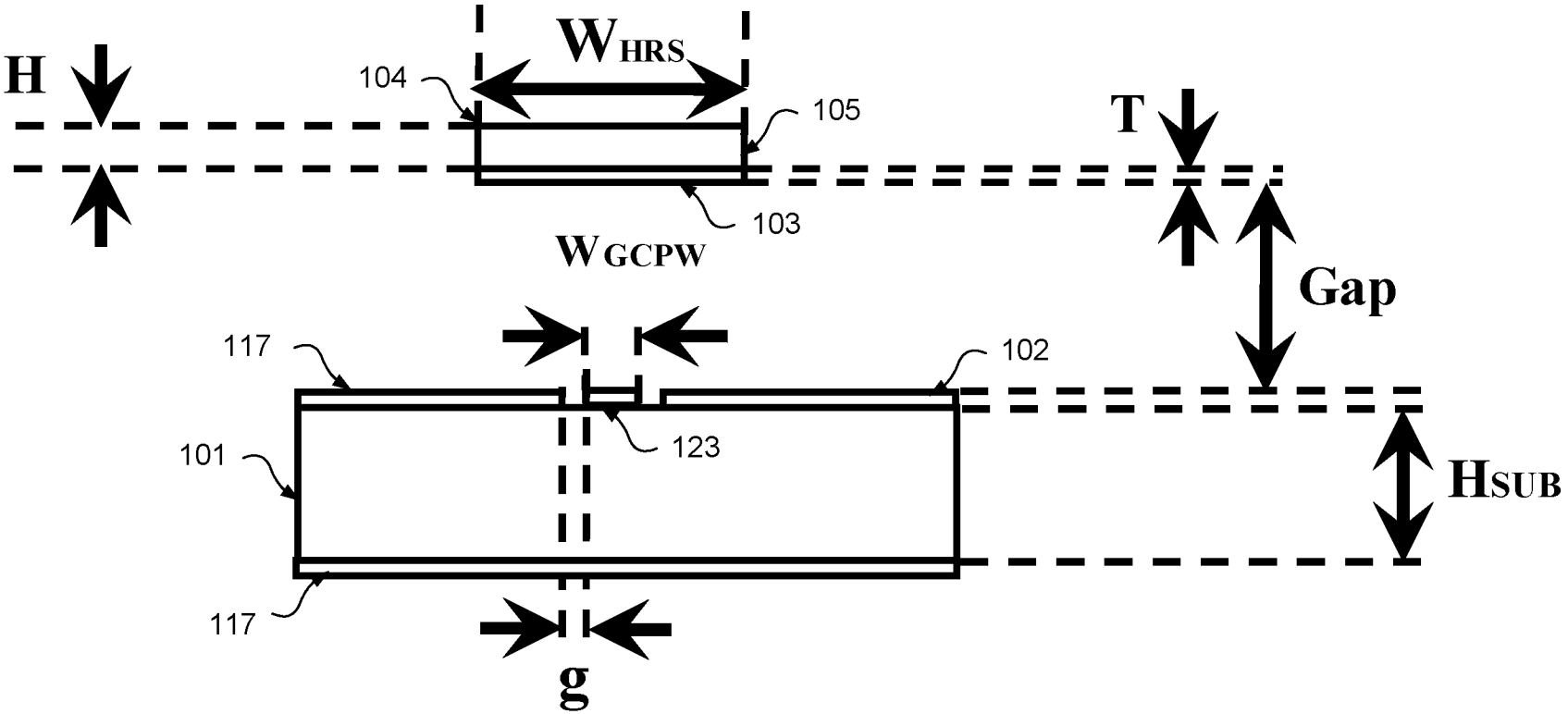
FIG. 2 is a schematic cross-sectional view of the transmission line and the perturber of the phase shifter shown in FIG. 1.

FIG. 2 provides a schematic cross-sectional view of the GCPW transmission line 102 and the perturber 104 of the phase shifter 100 shown in FIG. 1.

As shown in FIG. 2, the GCPW transmission line 102 includes a signal line 123 (e.g., a metal conductor) for carrying input and output signals and a ground 117 (e.g., a metal ground) formed on both sides of the substrate 101. The signal line 123 has a width ($W_{GCPW}$) and a gap (g) exists between the signal line 123 and the ground 117. The height of the substrate 101 is shown as $H_{SUB}$.

The perturber 104 includes a HRS slab 105 coated with a plurality of metallic gratings 103. The width of the HRS slab 105 is shown as $W_{HRS}$, the height of the HRS slab 105 is shown as H, and the height of the metallic gratings 103 is shown as T.

According to the embodiment, the HRS slab 105 is a slab of intrinsic silicon with high resistivity. In one exemplary example, the HRS slab 105 has a resistivity of 3000 Ω·cm and a relative dielectric constant of 11.6. In one exemplary example, the dimensions of the HRS slab 105 are 2×3×0.3 $mm^3$.

In one exemplary example, the substrate 101 for the GCPW transmission line 102 is made from Rogers™ 4360. In the example, the substrate 101 has a relative dielectric constant of 6.15 and dielectric loss tangent of 0.0038. In one implementation, the thickness of the substrate 101 is 8 mm.

It should be understood that while the description provides several specific numbers to describe the various parameters of the phase shifter 100, the description is not limited to these numbers and other values can be used within the knowledge of the skilled person. For example, the HRS slab can have any high resistivity of, for example but not limited to, above 4000 Ω·cm.

The use of HRS slab 105 with metallic gratings 103 enables low average insertion loss as well as low insertion loss variation throughout the tuning range. The crystalline structure of Silicon enables a smooth surface for the HRS slab 105 to coat the metallic gratings 103. HRS has a relatively high dielectric constant which helps reduce the phase velocity of the traveling wave. On the other hand, HRS also shows low loss in high frequencies improving the performance of the phase shifter 100. Metallic gratings 103 are periodic structures that can decrease the phase velocity of the travelling wave due to the slow-wave phenomenon.

According to the embodiment, the tunability of the phase shifter 100 is realized by controlling the vertical distance (shown as Gap in FIG. 2) between the perturber 104 and the GCPW transmission line 102.

It is understood that phase shift can be provided by adding perturbation to a guiding structure. The perturbation alters the wave velocity of the guiding structure and as a consequence a phase shift is realized. The amount of phase shift (Δφ) is proportional to a shift of the propagation constant (Δβ) and an interaction length L between the perturber and the guiding structure. A perturbation of a small displacement (e.g., of the order of microns) of the vertical distance can be sufficient to obtain a full range of phase shift for a device length (L) of the order of the wavelength. The amount of phase shift can be calculated as:

$$\Delta\varphi=\Delta\beta\cdot L \quad (1)$$

where L is the interaction length between the perturber (e.g., the perturber 104) and the guiding structure (e.g., the GCPW transmission line 102) and in this case L is the length of the phase shifter 100. $\Delta\beta$ is the change in the phase constant ($\beta$) of the guiding structure when the perturber is suspended over the guiding structure. $\Delta\beta$ depends on the vertical distance (Gap) between the perturber and the guiding structure. The maximum phase shift ($\Delta\beta_{max}$) per interaction length is reached when there is a maximum change in the phase constant ($\Delta\beta$) of the transmission line and this happens when the perturber is at the minimum distance with respect to the guiding structure. As the perturber moves further from the guiding structure, $\Delta\beta$ decreases until the perturber and the guiding structure are far enough that they have minimum interaction and $\Delta\beta$ goes to zero.

Figure 3:
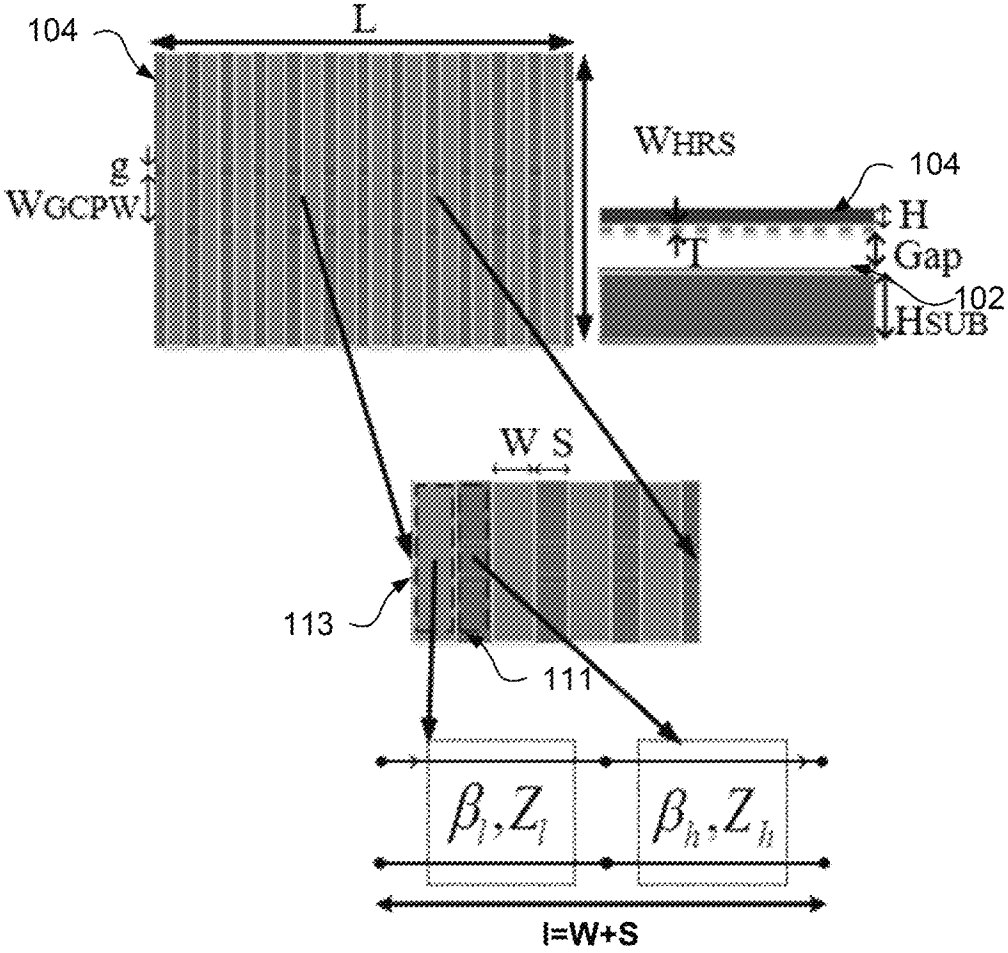
FIG. 3 is a schematic model of the transmission line of the phase shifter shown in FIG. 1.

To determine the maximum phase tuning range that can be reached, the perturber 104 is placed at the minimum vertical distance ($Gap_{min}$) with respect to the GCPW transmission line 102. For small gap values ($Gap \ll W_{HRS}$), the transmission line model of the structure can be defined as shown in FIG. 3. The reference labels L, g, H, T, $W_{GCPW}$, $W_{HRS}$, $H_{SUB}$, and Gap shown in FIG. 3 are the same as those defined with reference to FIG. 2.

The model is a periodic connection of two transmission lines with low and high impedances. If the alternating high and low impedance sections 111, 113 are short in length compared to the wavelength and the grating width (W, S) is small compared to the gap value (Gap), each section can be approximated by an L-C lumped element model. The low-impedance section 113 is the model for part of the structure where the metallic grating of the perturber 104 is disposed over the GCPW transmission line 102 which increases the line capacitance and decreases the line inductance. The high-impedance section 111 is the model for part of the structure where there is no metallic grating over the GCPW transmission line 102. When the two sections 111, 113 are cascaded together, the series inductance is dominated by the high impedance section 111, while the capacitance is dominated by the low-impedance section 113. As a consequence, the phase velocity of the structure becomes slower and a phase shift is reached. The phase constant $\beta$ and the characteristic impedance Z of the structure are derived as:

$$\cos(\beta l) = \frac{(1+K)^2}{4K}\cos(\beta_l W + \beta_h S) - \frac{(1-K)^2}{4K}\cos(\beta_l W - \beta_h S) \quad (2)$$

$$Z = \sqrt{Z_l \cdot Z_h} \quad (3)$$

In (2), $\beta_l$ and $\beta_h$ show the phase constants of the low-impedance and high-impedance sections 113, 111 respectively, and $Z_l$ and $Z_h$ show the characteristic impedances of the low-impedance and high-impedance sections 113, 111 respectively, 1 equals W+S and K equals $Z_l/Z_h$.

Figure 4:
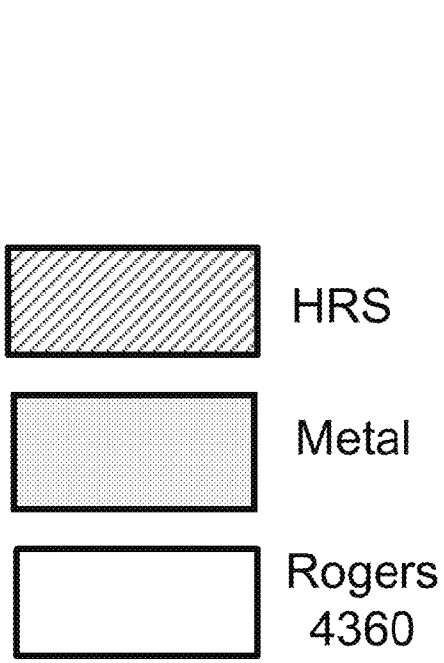
FIG. 4 shows a schematic cross-sectional view of three different perturbers disposed over the transmission line.
Figure 4:
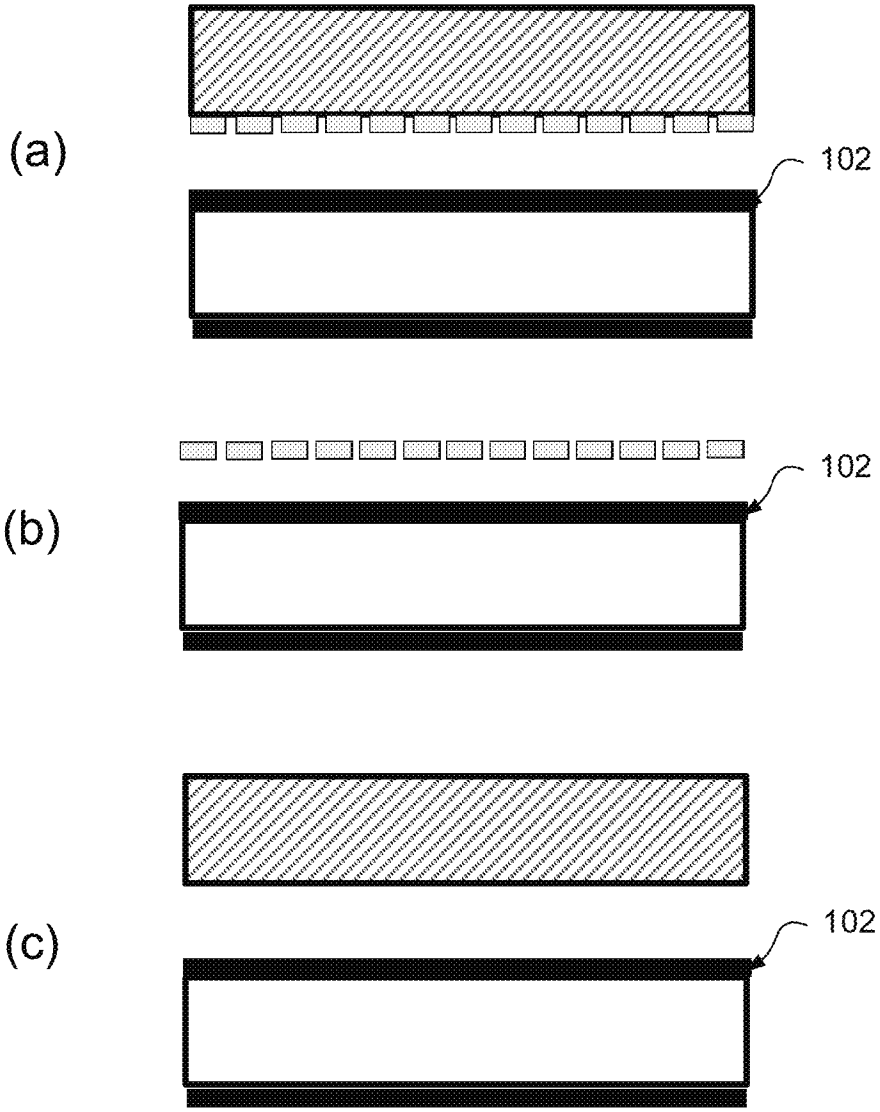

FIG. 4 illustrates three different perturbers placed over a same GCPW transmission line 102 having a substrate made of Rogers™ 4360. A HRS slab, represented with shading denoting HRS, coated with metallic gratings, represented with solid fill denoting metal, is used as the perturber in FIG. 4(*a*). In FIG. 4(*b*), the perturber is only metallic gratings; and in FIG. 4(*c*), a slab of HRS is used as the perturber. To compare their performances, the dispersion diagram and insertion phase response of the three perturbers as shown in FIG. 4 are evaluated. For the purpose of the evaluation, the structure is designed using parameters shown in FIG. 3 with values (in mm) shown in Table I.

TABLE I

| Parameter | | Parameter | | Parameter | |
|---|---|---|---|---|---|
| $W_{GCPW}$ | 0.28 | L | 3 | W | 0.05 |
| g | 0.11 | $W_{HRS}$ | 2 | S | 0.05 |
| $H_{SUB}$ | 0.2 | H | 0.3 | T | $0.21 \times 10^{-3}$ |

Figure 5:
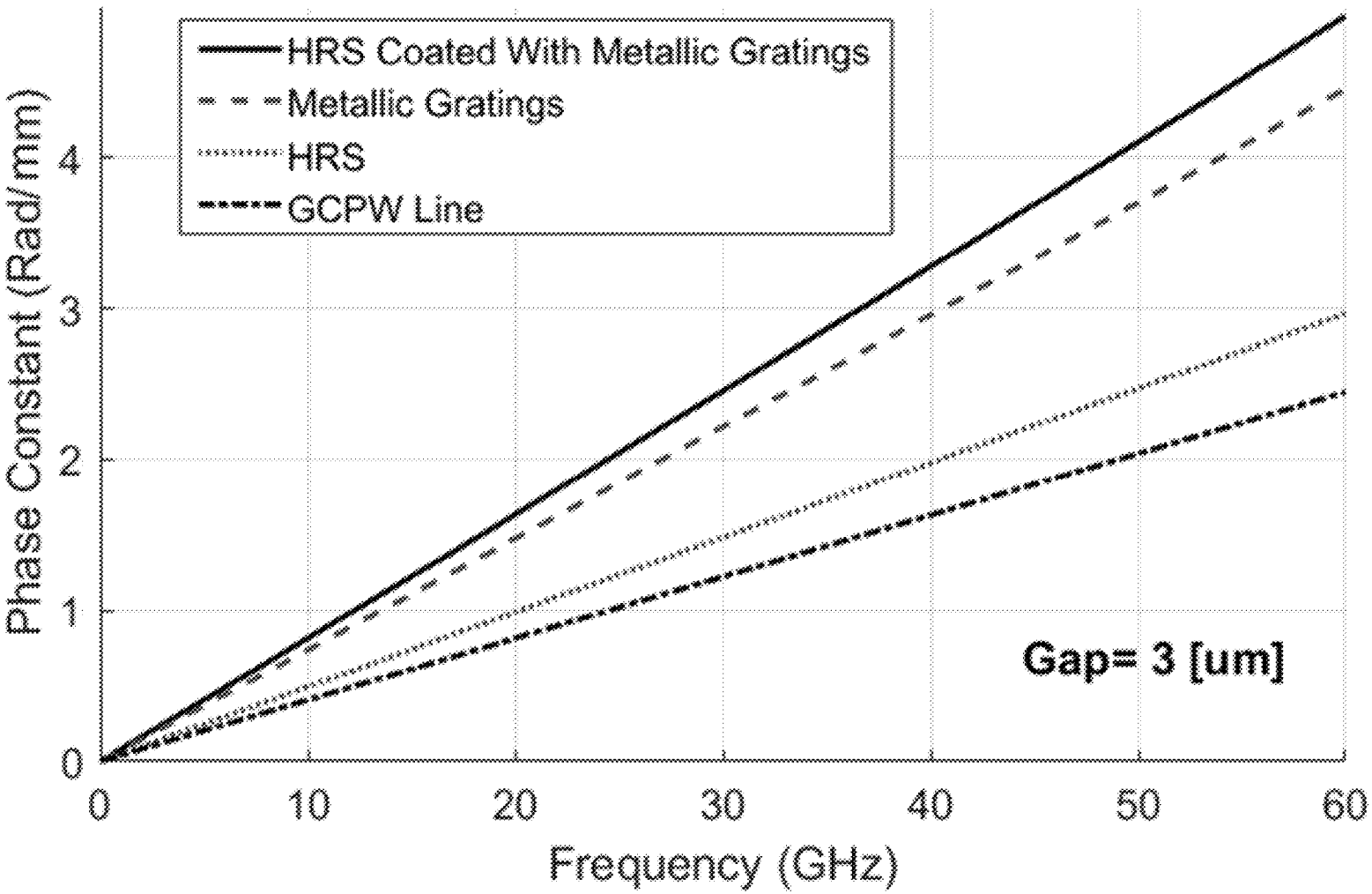
FIG. 5 shows a comparison of the dispersion diagram of the transmission line loaded with the three different perturbers in FIG. 4.

FIG. 5 is a graph of Phase Constant (Rad/mm) vs. Frequency (GHz) comparing the dispersion diagram of the three structures shown in FIG. 4 (namely, HRS coated with metallic gratings (solid line), metallic gratings (dashed line), and HRS (dotted line)) with an unloaded GCPW transmission line (dashed-dot line). For calculation of the dispersion diagram of the periodic structures (FIG. 4(*a*) and FIG. 4(*b*)), first the values of $\beta_l$, $\beta_h$, $Z_l$, and $Z_h$ are extracted using wave port analysis of ANSYS HFSS. Then, the extracted values are used in (2) to derive the dispersion diagram of the structures.

Figure 6:
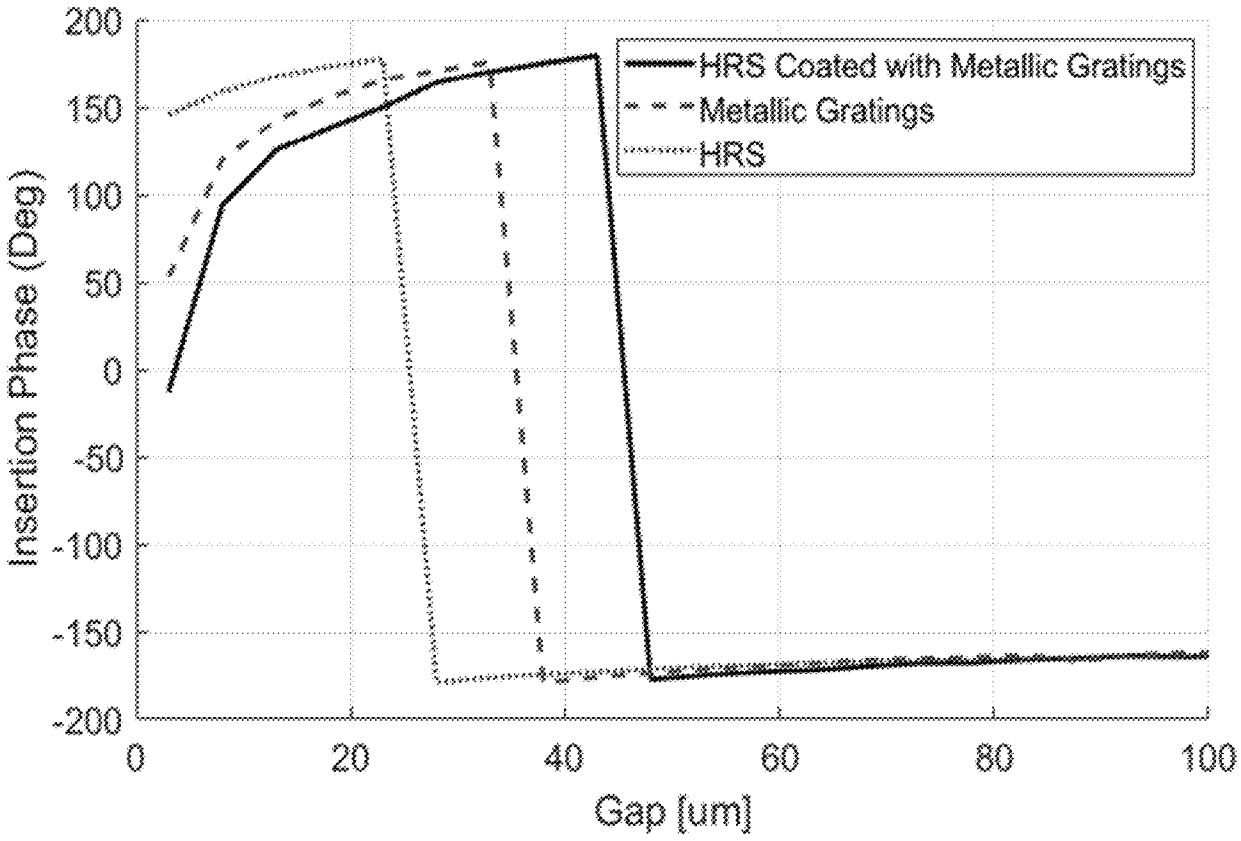
FIG. 6 shows a comparison of the insertion phase response of the phase shifter as a function of the vertical distance (Gap) values, using the three different perturbers in FIG. 4.

FIG. 6 shows the insertion phase response in degrees of the three structures (namely, HRS coated with metallic gratings (solid line), metallic gratings (dashed line), and HRS (dotted line)), as a function of different gap values (Gap) in pm at the frequency of 30 GHz. The results are extracted using full-wave EM simulations by HFSS.

The results show that HRS coated with metallic gratings has the highest phase constant and correspondingly provides the most phase tuning range.

Figure 7:
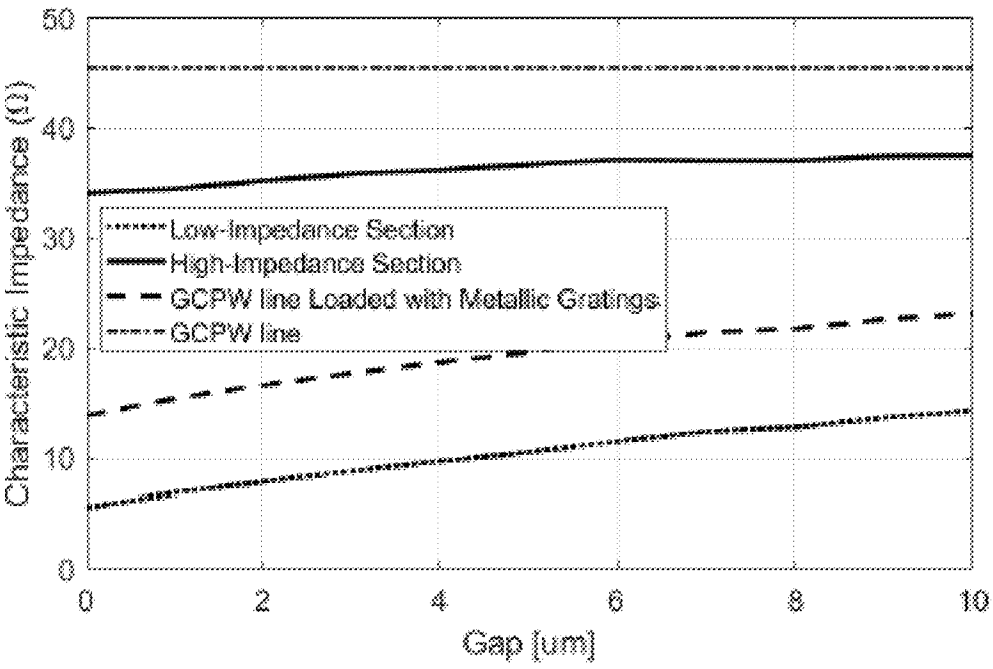
FIG. 7 shows the characteristic impedance at the frequency of 30 GHz using the perturber shown in FIG. 4(*a*).

Placing the perturber over the guiding structure alters the characteristic impedance of the guiding structure. The amount of alteration depends on the type of perturber and also the vertical distance (Gap) between the perturber and the guiding structure. FIG. 7 shows the change of the characteristic impedance in Q of the GCPW transmission line 102 at the frequency of 30 GHz. The characteristic impedance for the low-impedance section is shown using dotted lines, the characteristic impedance for the high-impedance section is shown using a solid line, the characteristic impedance for the GCPW line loaded with metallic gratings is shown using dashed lines, and the characteristic impedance for the GCPW line is shown using dash-dot lines. In order to compensate for the impedance variation, a corresponding matching network is used.

As shown in FIG. 7, for small Gap values in pm, the characteristic impedance of the GCPW transmission line 102 changes when the perturber 104 is suspended over it. This effect can be compensated by tuning the characteristic impedance of part of the GCPW transmission line 102 which has interaction with the perturber 104. For large gap values, the impedance matching can be realized by controlling the interaction length of the structure for the Fabry-Perot resonance. The bandwidth of the phase shifter 100 is limited to the impedance matching of the phase shifter 100. According to some embodiments of the description, the phase shifter 100 is designed to operate at the frequency range of 25-32 GHz.

In one embodiment, the impedance of the signal line 123 can be set to 70Ω under the perturber 104 in order to provide proper impedance matching for input and output impedance of 50Ω when the vertical distance (Gap) values are small.

Figure 8:
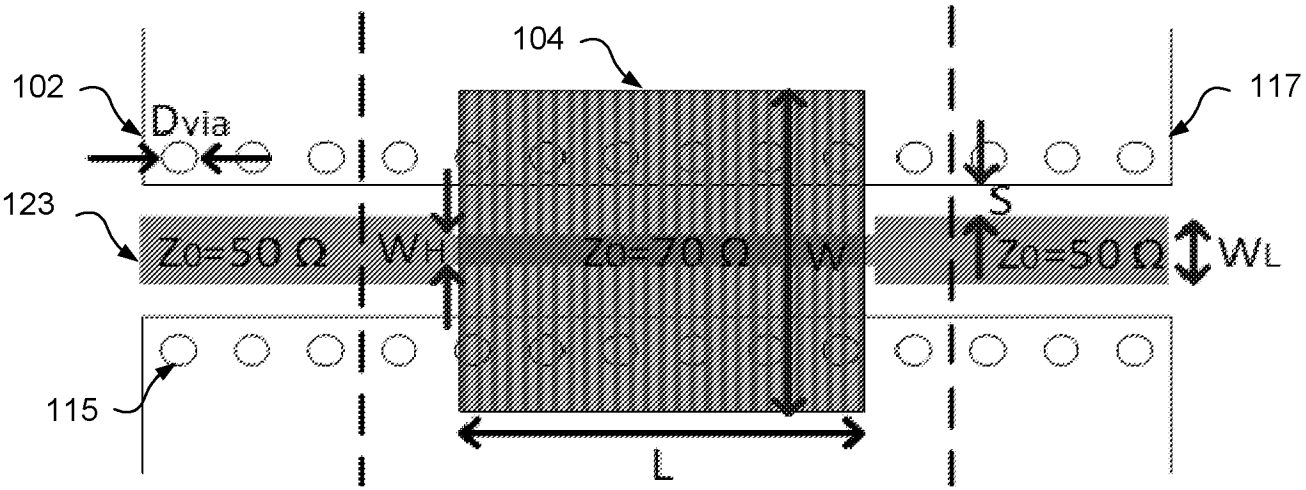
FIG. 8 is a schematic top view of the structure of the transmission line and the perturber of the phase shifter, according to one embodiment of the description.

FIG. 8 provides a schematic top view of the structure of the GCWP transmission line 102 and the perturber 104 of the phase shifter 100, according to one embodiment of the description. EM simulations have been performed to study the response of the structure for different gap values over the frequency range of 25-32 GHz. For the purpose of the simulation, the structure has been designed with parameters (mm) shown in Table II.

TABLE II

| Parameter | | Parameter | | Parameter | |
|---|---|---|---|---|---|
| $W_H$ | 0.12 | $W_L$ | 0.28 | $W_{HRS}$ | 2 |
| L | 3 | S | 0.11 | Dvia | 0.2 |

As shown in FIG. 8, $W_H$ is the width of the signal line 123 for the input and output signals, which has an impedance $Z_0$ of 50Ω. $W_L$ is the width of the signal line 123 under the perturber 104. Because the placement of the perturber 104 changes the impedance of the GCWP line 102, an impedance matching circuit or impedance transformer is provided so that the input and output lines have the same characteristics impedance as the impedance of the phase shifter. In this embodiment, this is done by changing the width of the signal line 123 from $W_H$ to $W_L$ and correspondingly changing the characteristic impedance from 50Ω to 70Ω. This way, the total size of the phase shifter 100 is kept small but impedance matching can be achieved. Dvia is the diameter of the metalized through holes 115 connecting the top metal ground 117 to the bottom metal ground. S is the distance between the transmission line 123 for the input and output signals and the metal ground 117.

Also, the interaction length can be determined to provide the impedance matching for large gap values due to the Fabry-Perot resonance. In one embodiment, the interaction length L is set at 3 mm.

Figure 9:
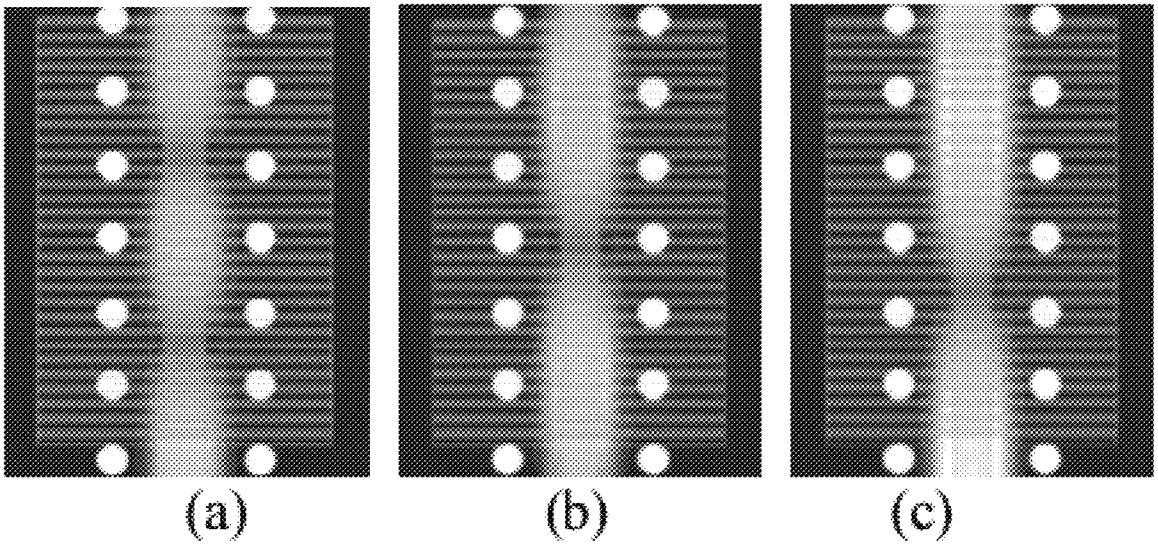
FIG. 9(*a*) shows the magnitude of the electric field for a gap value of 6 um.

FIG. 9 shows the magnitude of the electric field for three different gap values of (a) 6 um, (b) 18 um, and (c) 45 um at the frequency of 29 GHz. Simulation results show that by varying the gap from 3 um up to about 100 um, a phase shift range of 83°/mm can be achieved at the frequency of 30 GHz. The phase shifter 100 shows low insertion loss of 0.6±0.4 dB for different gap values in the frequency range of 25-32 GHz. Simulation results also show low insertion loss variation of 0.4 dB for different gap values. As well, the simulation results show that the phase shifter has low return loss of less than −12 dB in the operating frequency bandwidth.

According to various embodiments of the description, the tunability of the phase shifter 100 is realized by a magnetic actuation system that controls the movement of the perturber 104. The magnetic actuator moves the perturber slab 104 vertically with respect to the GCPW transmission line 102 and changes the vertical distance (Gap) to effect phase shift.

As shown in FIG. 1, the MEMS actuator includes a permanent magnet 107, a planar 2-layer spiral coil 108, a membrane 106 and a package 110.

Figure 10:
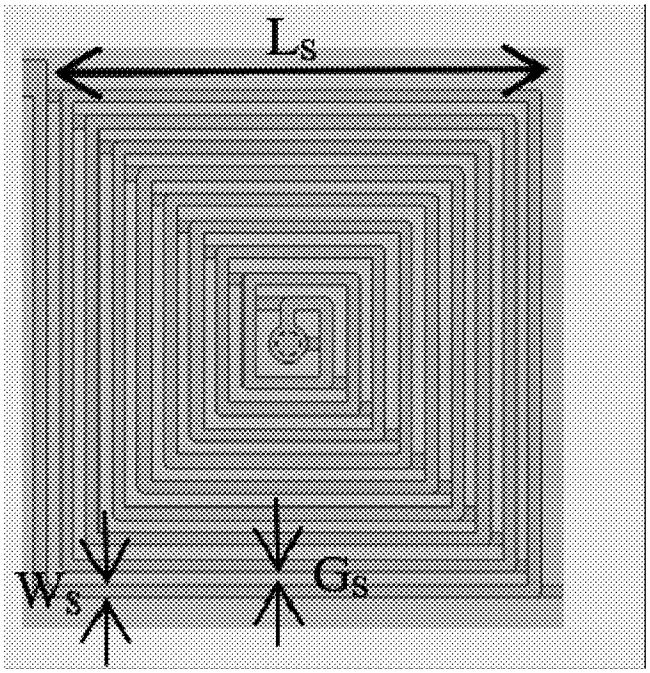
FIG. 10(*a*) shows a perspective view of a planar 2-layer spiral coil of the phase shifter, according to one embodiment of the description.
Figure 10:
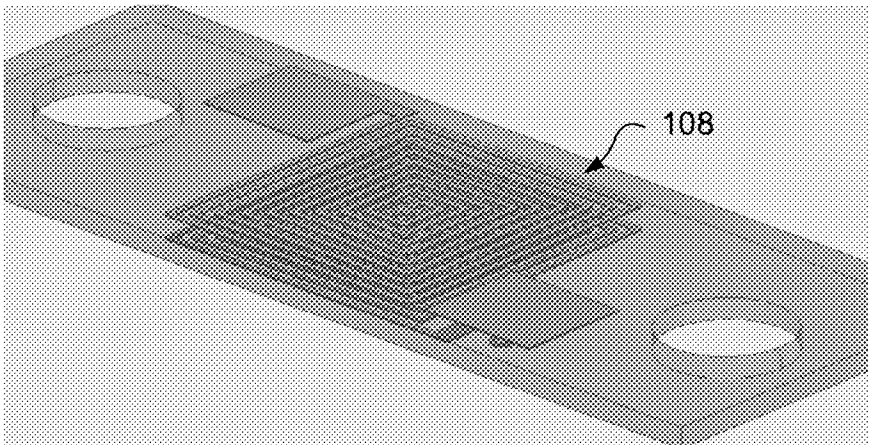

According to one embodiment of the description, the permanent magnet 107 is a miniaturized light-weight permanent magnet made from samarium-cobalt (SmCo) with high magnetization. The package 110 is a 3-D printed enclosure. FIG. 10(*a*) shows a perspective view of the planar 2-layer spiral coil 108 of the phase shifter; FIG. 10(*b*) shows a top view of the planar 2-layer spiral coil 108, and shows the structure of the planar 2-layer spiral coil 108, with design parameters $L_S$, $W_S$, and $G_S$.

Figure 11:
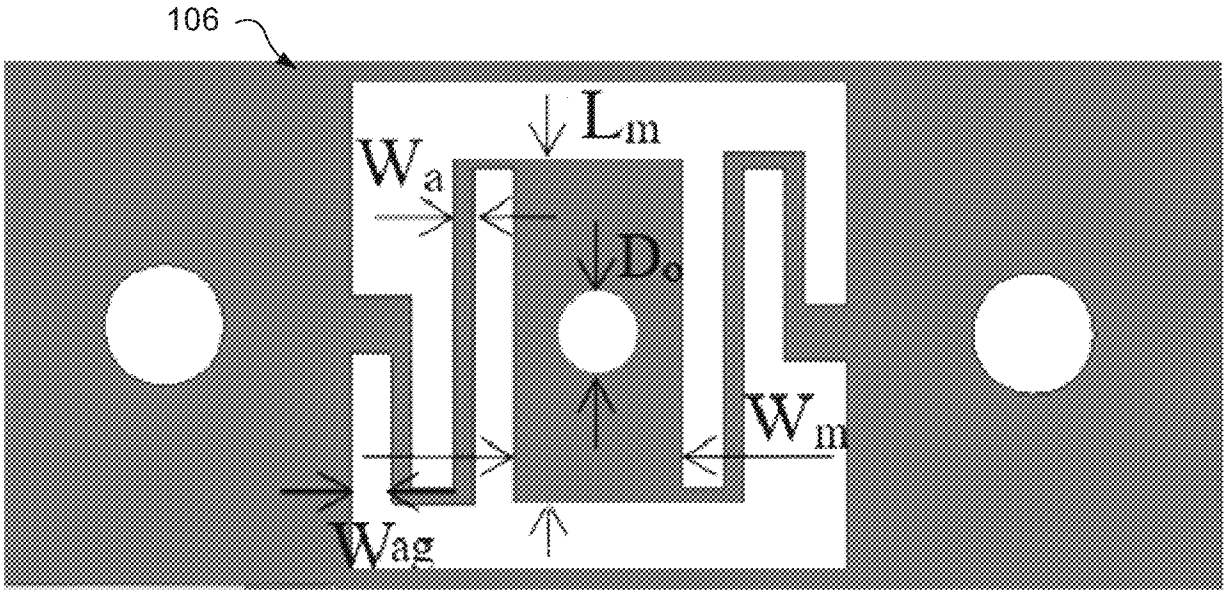
FIG. 11 is a top view of the membrane of a phase shifter, according to one embodiment of the description.

FIG. 11 shows the structure of the membrane 106. According to one embodiment of the description, the membrane 106 is made from a suitably thin polyimide material which has proper elasticity for movement. The membrane 106 has design parameters $D_O$, $L_m$, $W_m$, $W_a$, and $W_{ag}$.

The MEMS actuator 106, 107, 108, 110 utilizes the repulsion and attraction forces occurring between the permanent magnet 107 and the planar 2-layer spiral coil 108 to move the perturber slab 104 with high precision and in a repeatable manner. By passing electric current into the planar 2-layer spiral coil 108, a magnetic field is generated which exerts magnetic forces to the permanent magnet 107 and moves the permanent magnet 107 that is attached to the membrane 106 and in turn moves the perturber slab 104. The direction of current determines the direction of the movement. In one implementation, the design parameters (mm) of the planar 2-layer spiral coil 108 and the membrane 106 are listed in Table III.

TABLE III

| Parameter | | Parameter | |
|---|---|---|---|
| $W_S$ | 0.28 | L | 3 |
| $G_S$ | 0.11 | $W_{HRS}$ | 2 |
| $L_S$ | 3 | $W_{ag}$ | 0.3 |
| $D_o$ | 0.5 | $W_a$ | 0.203 |

The metallic gratings 106 are fabricated using a high-precision microfabrication technique.

Figure 12:
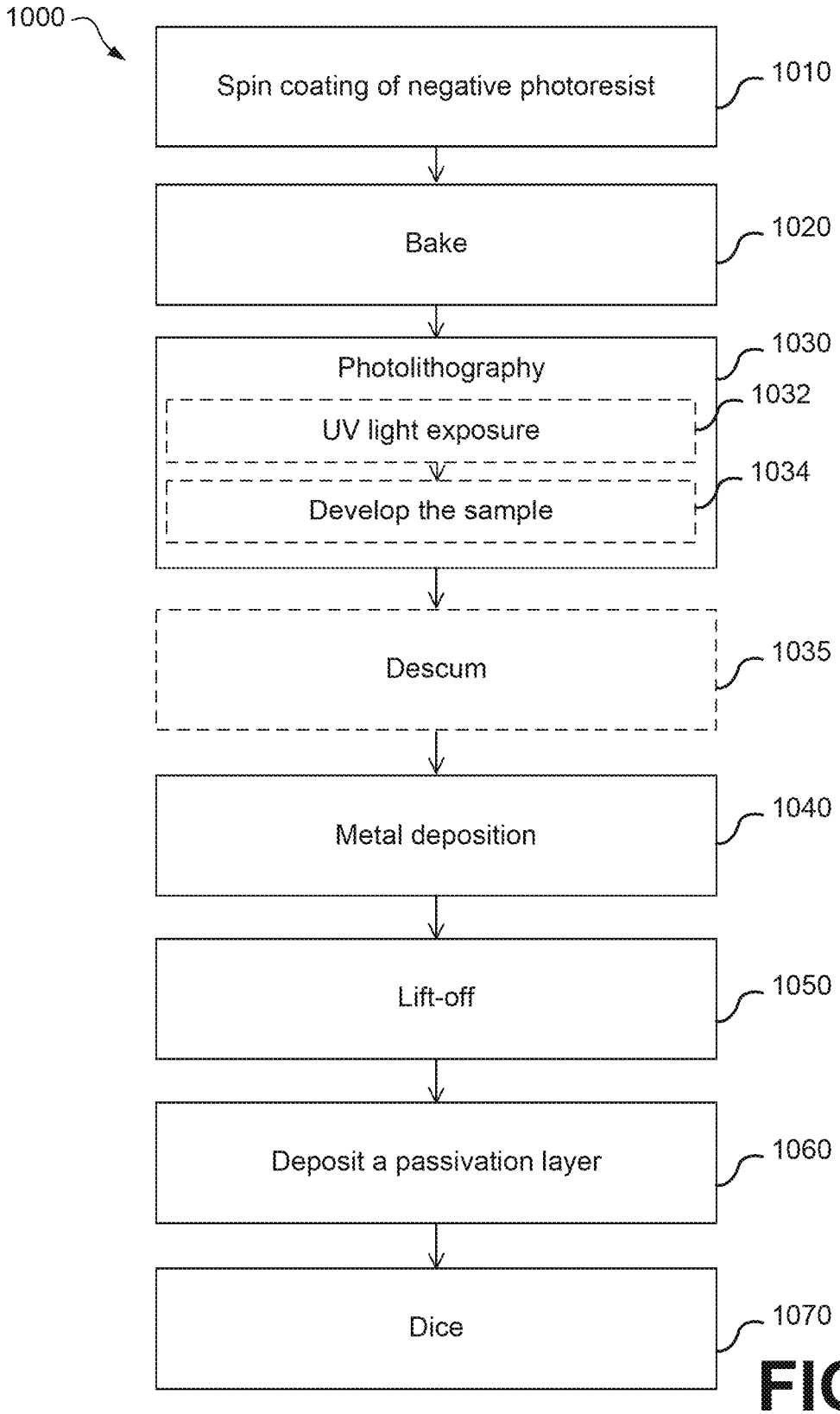
FIG. 12 is a fabrication process of the metallic gratings, according to one embodiment of the description.

FIG. 12 provides a fabrication process of the metallic gratings 106, according to one embodiment of the description.

The metallic grating layer is fabricated by photolithography. In one embodiment, the process 1000 starts with a spin coating (1010) of a negative photoresist. An example of the photoresist can be ma-N 1410. The spin coating can be performed at a speed of 3000 rpm and acceleration of 500 rpm/s for 60 seconds. The sample is then baked (1020) on a hot plate. In one implementation, the sample is based at 110° C. for 90 seconds. The resulting thickness of the photoresist is about 950 nm. This layer is then patterned via photolithography (1030) using a chrome photomask. During this step 1030, the photoresist may be exposed (1032) to UV light. In one implementation, the UV light has an intensity of 350 mW/cm$^2$ and the photoresist is exposed at a wavelength of 365 nm for 35 seconds. This is then be followed by developing (1034) the sample in a developer such as ma-D 533/S. A descum process (1035) can be performed between the steps of lithography (1030) and metal deposition (1040) to remove any thin photoresist residue which could cause poor metal adhesion. In one implementation, the descum process (1035) is performed by an oxygen plasma ashing of about 20 seconds at a low temperature. Then, a metal layer can be deposited (1040) by electron beam evaporation. The metal layer can include a Titanium adhesion layer of 10 nm and a copper layer of 200 nm. It should be understood that the metal layer can be made from other metals with good conductivity, such as but limited to aluminum, gold, and silver. A lift-off process (1050) is then performed. In one implementation, the lift-off process is performed in Remover PG heated to 80° C. with the use of liquid pressure from a pipette. After fabricating the metallic gratings 106, an $Al_2O_3$ passivation layer 201 (see FIG. 13) can be deposited (1060) using an electron beam evaporation system. In one implementation, the $Al_2O_3$ passivation layer 201 of 450 nm is deposited. The wafer can then be diced (1070) into pieces for use of the perturber slab 104

Figure 13:
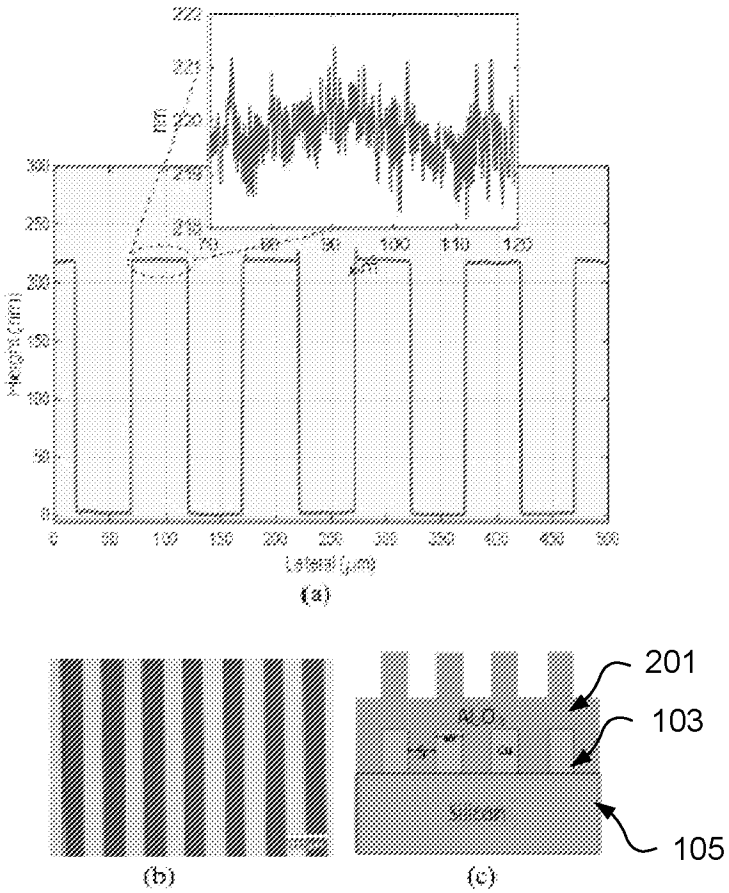
FIG. 13(*a*) shows a profile pattern of the metallic gratings before deposition of an $Al_2O_3$ layer.

FIG. 13(*a*) shows a roughness profile of the metal grating 103 measured by a profilometer before the deposition of the $Al_2O_3$ layer 201 as shown in FIG. 13(*c*). The grating teeth surface is smooth with arithmetic average of the roughness profile Ra≈0.63 nm (see the inset of FIG. 13(*a*)). FIG. 13(*b*)

shows the optical microscope image of the fabricated metal gratings after the $Al_2O_3$ deposition. The wafer can then be diced into pieces of 2×3 $mm^2$ for use of the perturber slab 104 as described with reference to FIG. 12. In one embodiment, a HRS wafer with a thickness of 320±5 um is used as the slab 104. FIG. 13(*c*) provides a schematic cross-sectional view of the grating structure, according to one embodiment of the description, showing the HRS slab 105, the metal gratings 103, and the $Al_2O_3$ layer 201.

Figure 14:
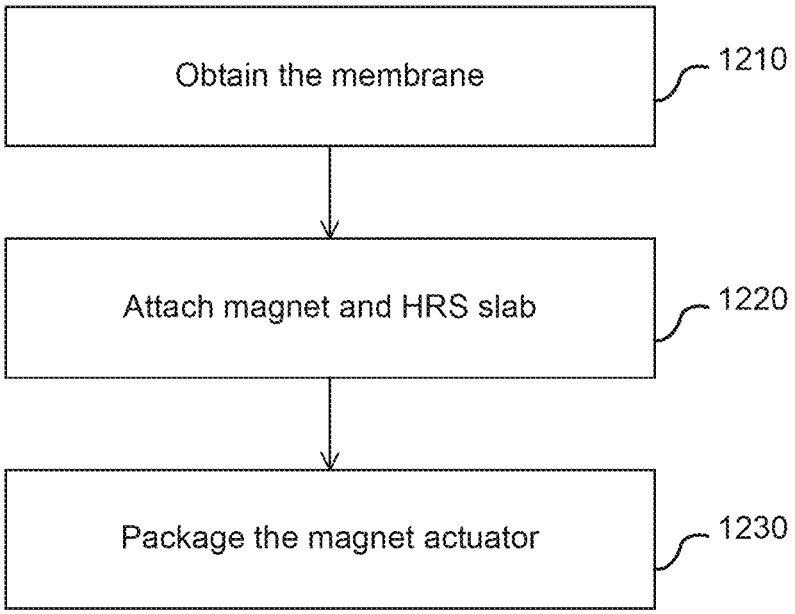
FIG. 14 is an assembly process of a phase shifter package, according to one embodiment of the description.

FIG. 14 provides an assembly process of the package 110, according to one embodiment of the description.

In step (1210), the polyimide membrane 106 is obtained. In one embodiment, the membrane 106 is made from polyimide material and it is patterned by laser machining. The permanent magnet 107 and the HRS slab 104 are then attached (1220) to two sides of the membrane 106. The miniaturized permanent magnet 107 used in this example is made of highly magnetized SmCo. A 3D-printed enclosure 110 is used to package (1230) the membrane 106, the magnet 107, the HRS 104, and the planar spiral coil 108. In one exemplary example, the planar spiral coil 108 can be fabricated using PCB technology and the spiral coil is able to carry up to 400 mA of direct current (DC) current.

Figure 15:
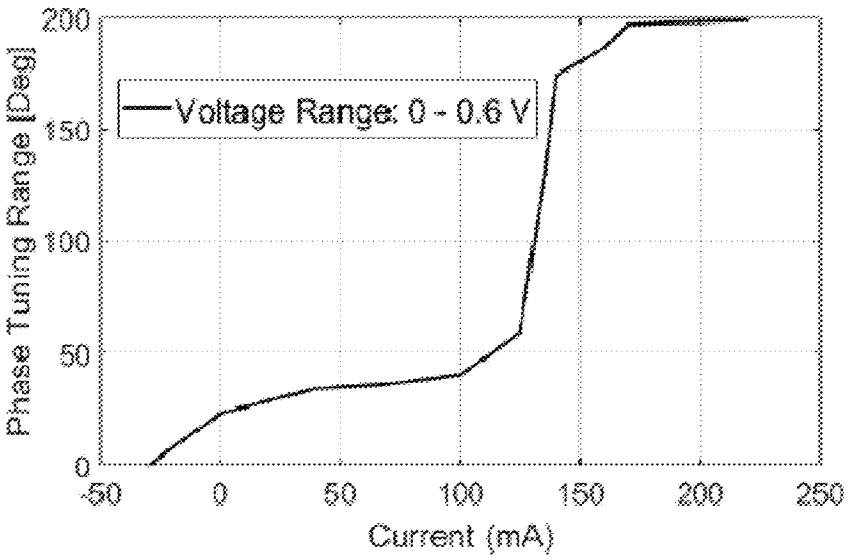
FIG. 15 shows measured results of the phase tuning range with respect to the direct current at the frequency of 30 GHz, according to one embodiment of the description.

FIG. 15 is a graph of phase tuning range (deg) vs. current (mA) showing the measured results of the phase tuning range with respect to the DC applied to the spiral coil 108 at the frequency of 30 GHz.

In the initial state of the phase shifter 100, the HRS slab 104 is placed over the GCPW transmission line 102 and the DC current is zero. By increasing the current in the reverse direction, the HRS slab 104 is pressed on the GCPW line 102. As shown in FIG. 15, 30 mA of DC current in reverse direction can provide 250 of phase shift. FIG. 15 also shows that increasing the DC current up to 100 mA in the forward direction does not increase the phase difference significantly due to the effect of the gravity. To lift the HRS slab, only a DC current of 100 mA is required. By adjusting the initial position of the HRS slab 104, the initial DC current for the slab 104 lift-up is not required anymore and DC power consumption can be decreased significantly. By increasing the DC current up to 130 mA from 100 mA, wide phase tuning range of 1350 can be achieved. As shown in FIG. 15, most part of phase tuning range can be achieved with gap values of between 3 um and 25 um. The DC current of more than 130 mA does not have significant effect on the phase tuning range. The phase shift of 250 is obtained by increasing the current from 130 mA to up to 200 mA. Increasing the DC current to more than 2000 does not change the insertion phase of the structure because of the minimum interaction of the GCPW transmission line and the HRS slab. The tuning voltage of 0-0.6 volt is used for generating DC current of 0-200 mA.

According to various embodiments of the description, the design and implementation of a novel low-cost wide-band MEMS-Based phase shifter at Ka-band is provided. The phase shifter operates by suspending a slab of HRS 105 coated with metallic gratings 106 over a GCPW line 102. The tunability of the phase shifter 100 is realized by controlling the gap between the slab of HRS 104 and the GCPW line 102. The fabricated phase shifter shows insertion loss of 1.5±0.6 dB and insertion loss variation of 0.8 dB in the frequency range of 25-32 GHz. The phase shifter shows the phase tuning range of 75°/mm at 30 GHz. The discrepancy in the simulation and measurement results of the phase tuning range is mainly due to the roughness of the GCPW line 102.

The actuator draws up to 230 mA of DC current to realize the phase tuning range of 66°/mm. Voltage range of 0-0.6 volts is used to provide DC current range of 0-200 mA. The relatively high level of DC power consumption is mainly due to the ohmic loss of planar spiral coil used in the actuator system and also the initial position of the HRS slab. Modifying and optimizing the actuator system can alleviate the power consumption issue.

While several embodiments have been provided in the present disclosure, it should be understood that the disclosed systems and methods might be embodied in many other specific forms. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made. The scope of the claims should not be limited by the preferred embodiments set forth in the examples, but should be given the broadest interpretation consistent with the description as a whole.

What is claimed is:

1. A planar micro-electromechanical system (MEMS)-based phase shifter, comprising:

a dielectric substrate;

a grounded coplanar waveguide (GCPW) transmission line for carrying input and output signals;

a high-resistivity silicon (HRS) slab coated with metallic gratings disposed over the GCPW transmission line; and a MEMS actuator for adjusting a distance between the HRS slab and the GCPW transmission line to provide a phase shift.

2. The planar MEMS-based phase shifter according to claim 1, wherein the phase shifter provides phase shifting in a frequency range of 25-32 GHz.

3. The planar MEMS-based phase shifter according to claim 1, wherein the phase shifter has a phase tuning range of about 75-80°/mm.

4. The planar MEMS-based phase shifter according to claim 1, wherein the HRS slab has a length of 3 mm.

5. The planar MEMS-based phase shifter according to claim 1, wherein the HRS slab has a resistance of 3000 Ω·cm.

6. The planar M EMS-based phase shifter according to claim 1, wherein the GCWP transmission line has an impedance of 70Ω.

7. The planar MEMS-based phase shifter according to claim 1, wherein a width of the GCWP transmission line is reduced under the HRS slab to provide impedance matching.

8. The planar MEMS-based phase shifter according to claim 1, wherein the MEMS actuator includes a permanent magnet, a planar 2-layer spiral coil, a membrane, and a package enclosing the permanent magnet, the planar 2-layer spiral coil, and the membrane, wherein the permanent magnet is attached to the membrane, and wherein the planar 2-layer spiral coil is configured to generate a magnetic field that moves the permanent magnet when an electric current is passed through the planar 2-layer spiral coil.

9. The planar MEMS-based phase shifter according to claim 8, wherein the permanent magnet is a permanent magnet made from samarium-cobalt.

10. The planar MEMS-based phase shifter according to claim 8, wherein the package is a 3-D printed enclosure.

11. The planar MEMS-based phase shifter according to claim 8, wherein the membrane is made from a polyimide material.

12. The planar MEMS-based phase shifter according to claim 8, wherein the HRS slab coated with metallic gratings is attached to one side of the membrane.

* * * * *